United States Patent [19]

Cunningham et al.

[11] Patent Number: 4,729,155

[45] Date of Patent: Mar. 8, 1988

[54] METHOD OF MAKING HEAT TRANSFER TUBE WITH IMPROVED OUTSIDE SURFACE FOR NUCLEATE BOILING

[75] Inventors: James L. Cunningham; Bonnie J. Campbell, both of Decatur, Ala.

[73] Assignee: Wolverine Tube, Inc., Decatur, Ala.

[21] Appl. No.: 907,868

[22] Filed: Sep. 16, 1986

Related U.S. Application Data

[62] Division of Ser. No. 744,076, Jun. 12, 1985, Pat. No. 4,660,630.

[51] Int. Cl.[4] ..... B21D 53/02

[52] U.S. Cl. ..... 29/157.3 AH; 29/157.3 R; 29/157.3 A; 165/179

[58] Field of Search ..... 29/157.3 A, 157.3 AH, 29/157.3 R; 165/179; 29/157.4, 727, 226

[56] References Cited

U.S. PATENT DOCUMENTS 4,313,248 2/1982 Fujikake ..... 29/157.3 AH X
4,438,807 3/1984 Mathur et al. ..... 165/179

*Primary Examiner*—Howard N. Goldberg
*Assistant Examiner*—Irene Graves Golabi
*Attorney, Agent, or Firm*—Barry L. Clark

[57] ABSTRACT

Improved heat transfer tube and method of making same has mechanical enhancements which can individually improve either the inner or outer surfaces or which can cooperate to increase the overall efficiency of the tube. The internal enhancement, which is useful on either boiling or condensing tubes, comprises a plurality of closely spaced helical ridges which provide increased surface area and are positioned at an angle which gives them a tendency to swirl the liquid. The external enhancement, which is applicable to boiling tubes, is provided by successive cross-grooving and rolling operations performed after finning. The finning operation, in a preferred embodiment for nucleate boiling, produces fins while the cross-grooving and rolling operation deforms the tips of the fins and causes the surface of the tube to have the general appearance of a grid of generally rectangular flattened blocks which are wider than the fins and separated by narrow openings between the fins and narrow grooves normal thereto. The roots of the fins and the cavities or channels formed therein under the flattened fin tips are of much greater width than the surface openings so that the vapor bubbles can travel outwardly through the cavity and to and through the narrow openings. The cavities and narrow openings and the grooves all cooperate as part of a flow and pumping system so that the vapor bubbles can readily be carried away from the tube and so that fresh liquid can circulate to the nucleation sites. The rolling operation is performed in a manner such that the cavities produced will be both larger and smaller than the optimum minimum pore size for nucleate boiling of a particular fluid under a particular set of operating conditions.

4 Claims, 12 Drawing Figures

FIG. 1
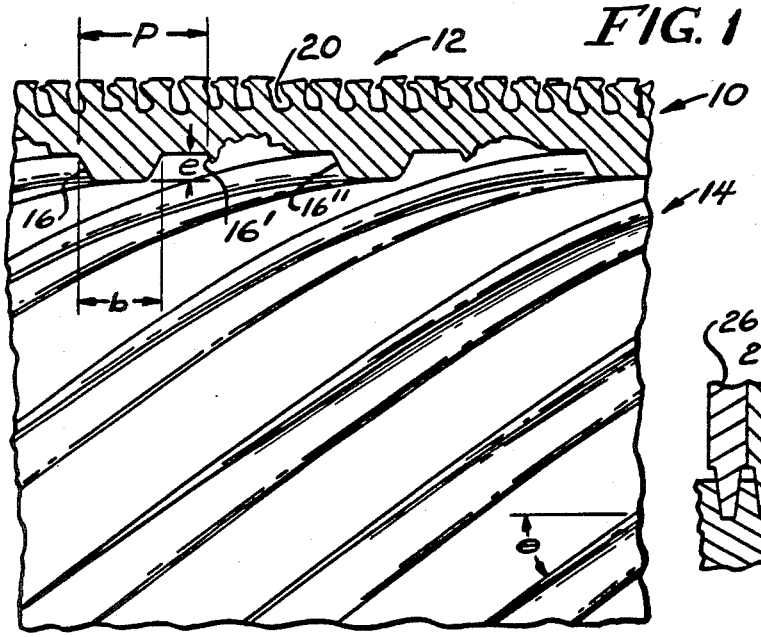
FIG. 2
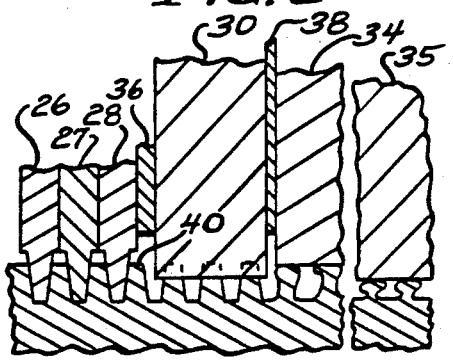
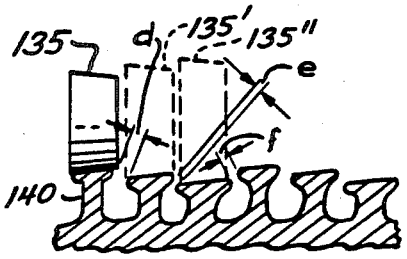
FIG. 5
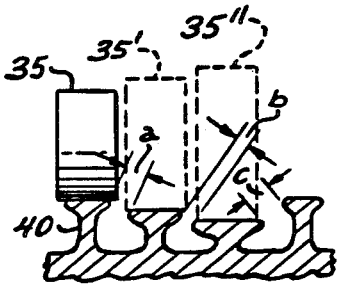
FIG. 3
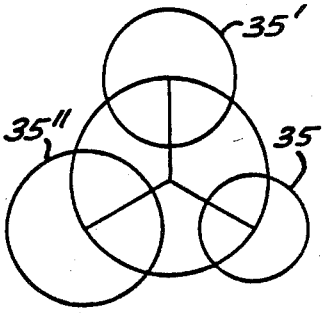
FIG. 4
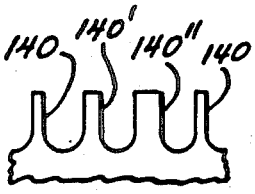
FIG. 6a
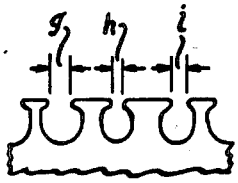
FIG. 6b
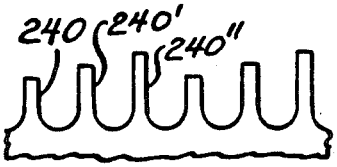
FIG. 7a
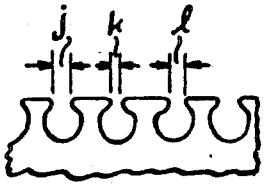
FIG. 7b FIG. 10
SINGLE-TUBE BOILING CURVE FOR R-11 @ 6.4 PSIA
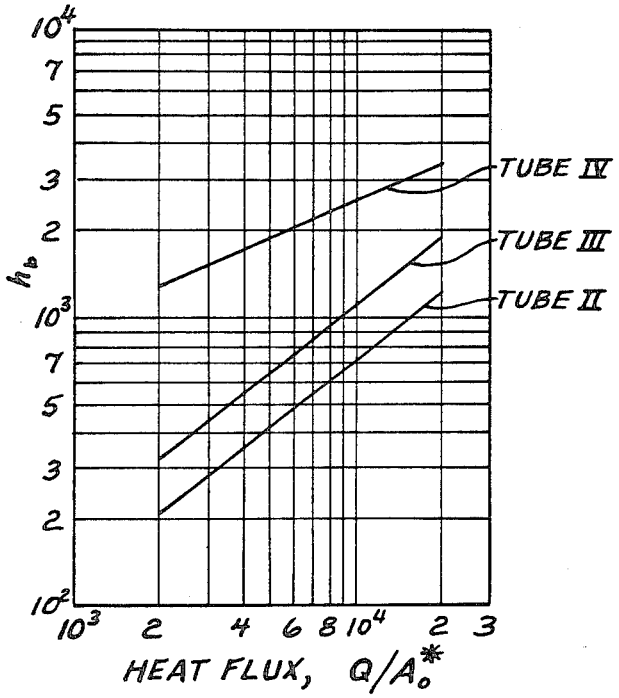
FIG. 9
HEAT TRANSFER VS. PRESSURE DROP CHARACTERISTICS OF DIFFERENT TYPES OF INTERNALLY RIDGED TUBES
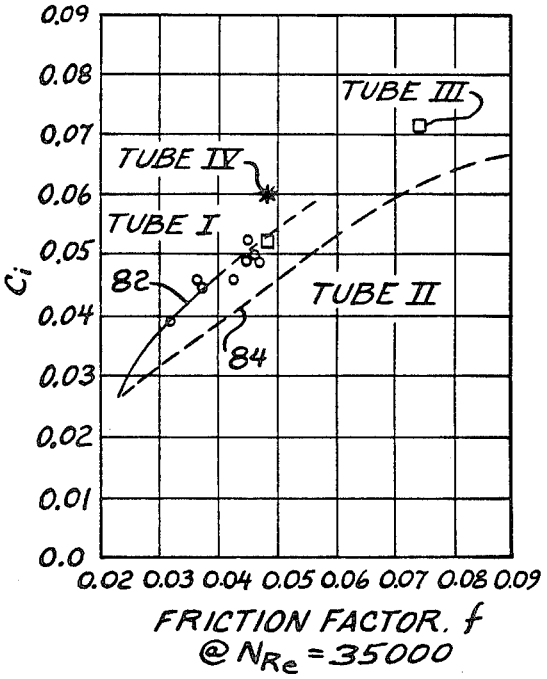
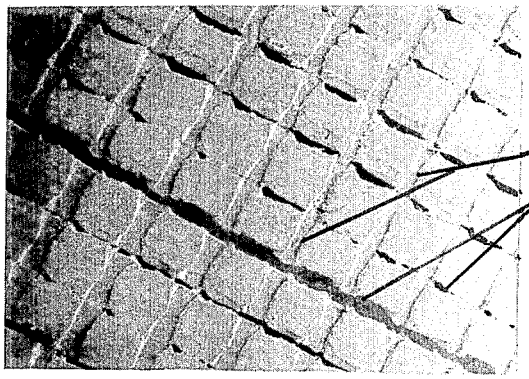
FIG. 8

METHOD OF MAKING HEAT TRANSFER TUBE WITH IMPROVED OUTSIDE SURFACE FOR NUCLEATE BOILING

This is a division of application Ser. No. 744,076, filed June 12, 1985, now U.S. Pat. No. 4,660,630.

BACKGROUND OF THE INVENTION

The invention relates to mechanically formed heat transfer tubes for use in various applications, including boiling and condensing. In submerged chiller refrigerating applications, the outside of the tube is submerged in a refrigerant to be boiled, while the inside conveys liquid, usually water, which is chilled as it gives up its heat to the tube and refrigerant. In condensing applications, the heat transfer is in the opposite direction from boiling applications. In either boiling or condensing, it is desirable to maximize the overall heat transfer coefficient. Also, anytime the efficiency of one tube surface is improved to an extent that the other surface provides the majority of the thermal resistance, it would of course be desirable to attempt to improve the said other surface. The reason for this is that an improvement in the reduction of thermal resistance of either side has the greatest overall benefit when the inside and outside resistances are in balance. Much work has been done to improve the efficiency of heat transfer tubes, and particularly boiling tubes, since it is easier to form enhancements on the outside surface as compared to the inside surface.

Typically, modifications are made to the outside tube surface to produce multiple cavities, openings, or enclosures which function mechanically to permit small vapor bubbles to be formed. The cavities thus produced form nucleation sites where the vapor bubbles tend to form and start to grow in size before they break away from the surface and allow additional liquid to take their vacated space and start all over again to form another bubble. Some examples of prior art patents relating to mechanically produced nucleation sites include Zatell U.S. Pat. No. 3,768,290, Webb U.S. Pat. No. 3,696,861, Campbell et al U.S. Pat. No. 4,040,479, Fujikake U.S. Pat. No. 4,216,826 and Mathur et al U.S. Pat. No. 4,438,807. In each of these patents, the outside surface is finned at some point in the manufacturing process. In the Campbell et al patent the tube is knurled before it is finned so as to produce splits during finning which are much wider than the width of the original knurl grooves and which extend across the width of the fin tips after finning. In the remaining patents, the fins are rolled over or flattened after they are formed so as to produce narrow gaps which overlie the larger cavities or channels defined by the roots of the fins and the sides of adjacent pairs of fins. The Fujikake patent provides an especially efficient outside surface which is produced by finning a plain tube, pressing a plurality of transverse grooves into the tips of the fins in the direction of the tube axis and then pressing down the fin tips to produce a plurality of generally rectangular, wide, thickened head portions which are separated from each other between the fins by a narrow gap which overlies a relatively wide channel in the root area of the fins.

The prior art has also considered the fact that it is not enough to merely improve the heat transfer efficiency of a tube on its boiling side. For example, Withers et al U.S. Pat. No. 3,847,212, which is assigned to a common assignee and incorporated by reference herein, discloses a finned tube with a greatly enhanced internal surface. The enhancement comprises the use of multiple-start internal ridges which have a ridge width to pitch ratio which is preferably in the range of 0.10–0.20. Thus, a longitudinal flat region exists between internal ridges which is substantially longer, in an axial direction, than the width of the ridge. The patentee states that heat transfer efficiency is improved by decreasing the width of the ridge relative to the pitch. Presumably, the efficiency would be expected to drop when the ridges are placed too close to each other since the fluid would tend to flow over the tips and not contact the flat surfaces in between the ridges. This condition would exist because the ridges were located generally transverse to the axis of the tube. Specifically, an angle of 39° from a line normal to the tube axis was disclosed. Obviously, the corresponding angle measured relative to the tube axis would be 51°. Although the Withers et al design balanced the efficiencies of the inner and outer surfaces relatively uniformly, its outer boiling surface was not as efficient as more recent developments such as the surface disclosed by Fujikake. Other tubes with internal ridges are disclosed in the following U.S. patents: Rodgers, U.S. Pat. No. 3,217,799; Theophilos, U.S. Pat. No. 3,457,990; French, U.S. Pat. No. 3,750,709; Rieger, U.S. Pat. No. 3,768,291; Fujie et al, U.S. Pat. No. 4,044,797 and Lord et al U.S. Pat. No. 4,118,944.

SUMMARY OF THE INVENTION

It is among the objects of the present invention to provide an improved heat transfer tube which includes surface enhancements of both of its inside and outside surfaces.

A further object is to provide an improved tube which can be produced in a single pass in a conventional finning machine.

Another object is to improve the flow of liquid inside the tube so as to optimize film resistance at a given pressure drop while also increasing the internal surface area so as to further increase heat transfer efficiency.

A still further object is to provide a nucleate boiling tube for submerged chiller refrigerating applications wherein the tube surface will contain cavities which are both smaller and larger than the optimum minimum pore size for nucleate boiling of a particular fluid under a particular set of operating conditions.

These and other objects and advantages are achieved by the improved tube and process of the present invention wherein the inside surface is enhanced by providing a large number of relatively closely spaced ridges which are arranged at a sufficiently large angle relative to the tube axis that they will produce a swirling turbulent flow that will tend, to at least a substantial extent, to follow the relatively narrow grooves between the ridges. However, the angle should not be so large that the flow will tend to skip over the ridges. The outer surface of the tube is also preferably enhanced. In a preferred embodiment for nucleate boiling, we prefer to use about 30 ridge starts for a 0.750" tube as compared to about 6–10 ridge starts for certain commercial embodiments of the prior art tube disclosed in Withers et al U.S. Pat. No. 3,847,212.

The preferred embodiment also includes an outside enhancement which comprises multiple cavities, enclosures and/or other types of openings positioned in the superstructure of the tube, generally on or under the outer surface of the tube. These openings function as small circulating systems which pump liquid refrigerants into a "loop", allowing contact of the liquid with either a beginning, potential or working nucleation site. Openings of the type described are disclosed by Fujikake and are preferably made by the steps of helically finning the tube, forming generally longitudinal grooves or notches in the tips of the fins and then deforming the outer surface to produce generally rectangular flattened blocks which are closely spaced from each other on the tube surface but have underlying relatively wide channels in the fin root areas. However, by forming said openings in a non-uniform manner so as to include cavities which are both larger and smaller than an optimum pore size, we have found that we can provide a substantial increase in overall tube performance, and can allow the aforesaid liquid contact even when the tubes are grouped in a bundle configuration within a boiling fluid of wide ranging vapor-liquid composition. This is significant, since it is recognized that the boiling curves are typically congruent for either single-tube or multiple-tube (bundle) operations for nucleate boiling tubes which have uniform porous surfaces and which depend on obtaining a certain uniform pore size suited to a given refrigerant. Thus, there is no improvement in the boiling curve when going from a single-tube to a bundle configuration for such uniform surfaced tubes as is commonly observed with tubes having ordinary smooth or finned external surfaces. This situation is tolerable where the porous outer tube surface is highly effective, such as would be true with the sintered surface disclosed in Milton U.S. Pat. No. 3,384,154 or the porous foam surface disclosed in Janowski et al U.S. Pat. No. 4,129,181. However, the aforementioned types of porous surfaces are quite expensive to produce. Thus, it would seem desirable to be able to produce a surface mechanically which, although not nearly effective as the Milton or Janowski et al surfaces in single-tube boiling, could at least be substantially improved in a bundle operation. The aforementioned mechanically formed Fujikake surface is quite uniform and thus would seem incapable of providing enhanced performance in going from a single-tube to a bundle operation. Fujikake seems to recognize this since he proposes the addition of "mountainous fins" to prevent deterioration of performance when the tube is used in a liquid rich in bubbles (eg, when the tubes are in bundles). This solution can adversely affect the economies of building the bundle since the addition of the "mountainous fin" would either increase the O.D. of each tube, or, for a particular O.D., result in a smaller I.D. than if the additional fins were not required.

By providing cavities which are both larger and smaller than optimum, such as by rolling down the fins on a tube with multiple fin starts with a series of rolling tools having progressively larger diameters which are placed on the finning arbors, we insure that sufficient boiling sites will be provided so that an improved boiling curve will be obtained at the single tube level of operation. Moreover, the structure allows the beneficial effect of the strong convection currents that are available in a boiling bundle to be realized so that the boiling curve for the bundle is even improved over the single tube curve. The structure apparently prevents the flooding out of active boiling sites and vapor binding which are thought to be the causes of degraded bundle performance relative to single tube performance. The variation in pore size also provides a tolerance for the fabricating operation as well as enabling the tube to be used satisfactorily with a variety of boiling fluids.

As previously stated, good tube design depends on improvements to both the inside and outside surfaces. This object has been achieved by the tube of the present invention which, in a 0.750" nominal O.D., was found to provide a 35% improvement in the tube side film resistance as compared to a commercially available tube of the same O.D. made in accordance with the teachings of Withers et al U.S. Pat. No. 3,847,212. The resistance allocated to the fouling allowance of the new tube has benefited by the increased internal surface area of the new tube as compared to the aforesaid commercially available tube and was shown to amount to an improvement of 28%. The boiling film resistance was improved by 82% over that of the aforesaid commercially available tube.

BRIEF DESCRIPTION OF THE DRAWINGS

FIG. 1 is an enlarged, partially broken away axial cross-sectional view of a tube incorporating the invention;

FIG. 2 is a view looking at a partially broken away axial cross-section of the tube at an end transition to illustrate the successive process steps performed on the tube of finning, grooving and rolling or pressing down the surface;

FIG. 3 is an enlarged, partially broken away, axial cross-sectional view of the tube of FIG. 1 showing a technique for forming a non-uniform outer surface and including, in dotted lines, a pair of surface compressing rollers which are actually located, as shown in FIG. 4, on other arbors which are spaced at positions of 120° and 240° around the circumference of the tube from the position shown in full lines;

FIG. 5 is an axial cross-sectional view similar to FIG. 3 but illustrating a modification in which tapered rollers are utilized to produce varying amounts of space between different fins;

FIGS. 6*a* and 6*b* are axial cross-sectional views showing an additional and preferred construction wherein varying spaces between fins are achieved by forming the fins to be of different widths, such as by using non-uniform spacers between finning disks of uniform thickness;

FIGS. 7*a* and 7*b* are axial cross-sectional views illustrating yet another modification wherein varying spaces between fins are achieved by forming the fins with varying heights;

FIG. 8 is a 20X photomicrograph of the tube outer surface;

FIG. 9 is a graph comparing heat transfer versus pressure drop characteristics for four different types of internally ridged tubes; and FIG. 10 is a graph comparing the external film heat transfer coefficient $h_b$ to the Heat Flux, $Q/A_o$*.

DETAILED DESCRIPTION OF THE PREFERRED EMBODIMENT

Referring to FIG. 1, an enlarged fragmentary portion of the improved tube 10 of the present invention is shown in axial cross-section. The tube 10 comprises a deformed outer surface indicated generally at 12 and a ridged inner surface indicated generally at 14. The inner surface 14 comprises a plurality of ridges, such as 16, 16', 16", although every other ridge, such as ridge 16', has been broken away for the sake of clarity. The particular tube depicted has 30 ridge starts and an O.D. of 0.750". The ridges are preferably formed to have a profile which is in accordance with the teachings of Withers et al U.S. Pat. No. 3,847,212 and have their pitch, p, their ridge width, b, and their ridge height, e, measured as indicated by the dimension arrows. The helix lead angle, $\theta$, is measured from the axis of the tube. Whereas U.S. Pat. No. 3,847,212 taught the use of a relatively low number of ridge starts, such as 6, arranged at a relatively large pitch, such as 0.333", and at a relatively large angle to the axis, such as 51°, the particular tube shown in FIG. 1 has 30 ridge starts, a pitch of 0.093" and a ridge helix angle of 33.5°. The new design greatly improves the inside heat transfer coefficient since it provides increased surface area and also permits the fluid inside the tube to swirl as it traverses the length of the tube. At the ridge angles which are preferred, the swirling flow tends to keep the fluid in good heat transfer contact with the inner tube surface but avoids excessive turbulence which could provide an undesirable increase in pressure drop.

The outer tube surface 12 is preferably formed, for the most part, by the finning, notching and compressing techniques disclosed in Fujikake U.S. Pat. No. 4,216,826, the subject matter of which is incorporated by reference herein. However, by varying the manner in which the tube surface 12 is compressed after it is finned and notched, it is believed that the performance of the outer surface is considerably enhanced, especially when the tubes are arranged in a conventional bundle configuration. Although the tube surface 12 appears in the axial section view of FIG. 1 to be formed of fins with compressed tips, the surface 12 is actually an external superstructure containing a first plurality of adjacent, generally circumferential, relatively deep channels 20 and a second plurality of relatively shallow channels 22, best shown in FIG. 8, which interconnect adjacent pairs of channels 20 and are positioned transversely of the channels 20. The tube 10 is preferably manufactured on a conventional three arbor finning machine. The arbors are mounted at 120° increments around the tube, and each is preferably mounted at a $2\frac{1}{2}$° angle relative to the tube axis. Each arbor, as schematically illustrated in FIG. 2, may include a plurality of finning disks, such as the disks 26, 27, 28, a notching disk 30, and one or more compression disks 34, 35. Spacers 36, 38 are provided to permit the notching and compression disks to be properly aligned with the center lines of the fins 40 produced by finning disks 26–28. Preferably, three fins are contacted at one time by the notching disk 30 and each of the compression disks 34, 35.

In order to achieve improved boiling performance of the outside tube surface 12 in a bundle configuration, we have found it desirable to make the surface somewhat non-uniform so that a range of sizes of openings are provided in the tube surface. The range should include openings which are both larger and smaller than the pore size which would best support nucleate boiling of a particular refrigerant at a particular set of operating conditions. Various ways in which a non-uniform surface can be provided are illustrated in FIGS. 3–7.

FIG. 3 represents, in a schematic fashion, a technique for producing openings of varying width a, b, c between adjacent fin tips 40 by rolling down adjacent tips to varying degrees. This is accomplished by forming the final rolling disks 35, 35' and 35" with slightly different diameters, as shown schematically in FIG. 4. By using three fin starts on the outside surface, each fin tip 40 will only be contacted by one of the three disks 35, 35' 35". The variation in diameter between rolling disks 35, 35' and 35" is actually quite small, but has been exagerated in the drawings for purposes of clarity. Also, the disks 35' and 35" are shown in dotted lines in FIG. 3 to indicate their axial spacing from disk 35. In actuality, they are spaced about the circumference of the tube at 120° angles, as shown in FIG. 4.

FIG. 5 is a modification of the arrangement of FIG. 3 in which the disks 135, 135' and 135" have tapered surfaces of different diameters which produce variable width gaps d, e, f.

FIG. **6*b* is a preferred modification of the arrangement of FIG. 3 which illustrates that varying width gaps g, h, i can be obtained with equal diameter rolling disks on three arbors, by forming the fins 140, 140', 140" of different widths, as best seen in FIG. 6*a***.

FIG. **7*b* is yet another modification which illustrates that varying width gaps j, k, l can be obtained with equal diameter rolling disks on three arbors, by forming the fins 240, 240', 240" of constant width, but varying height, as best seen in FIG. 7*a***.

In order to allow a comparison of the improved tube of the present invention to various known tubes, Tables I and II are provided to describe various tube parameters and performance results, respectively.

TABLE I

Dimensional and Performance Characteristics of Experimental Copper Tubes Having Multiple-Start Internal Ridging and Either Erect or Modified External Fins

| TUBE DESIGNATION | I | II | III | IV |
|---|---|---|---|---|
| Type Exterior | | | | |
| fins per inch (fpi) | 26 | 40 | 40 | 40 |
| posture of fins | Erect | Erect | Erect | Mangled |
| Fin Height (inches) | .053 | .033 | .061 | .024 |
| True Outside Area, $A_o$(ft$^2$/ft) | .665 | .586 | .901 | Unknown |
| $d_i$ = Inside Diameter (inches) | .820 | .628 | .573 | .632 |
| e = Ridge Height (inches) | .018 | .015 | .024 | .022 |
| p = Pitch of Ridge (inches) | .333 | .167 | .095 | .093 |
| $N_{RS}$ = Number Ridge Starts | 6 | 10 | 10 | 30 |
| l = Lead (inches) | 2.0 | 1.67 | .949 | 2.79 |
| $\theta$ = Lead Angle of Ridge from Axis (°) | 51.1 | 48.4 | 60.1 | 33.5 |
| b = Ridge Width Along Axis (inches) | .064 | .069 | .067 | .068 |
| b/p | .2 | .413 | .706 | .731 |
| $C_i$ = Inside Heat Transfer Coefficient Constant (From Test Results) | .052 | .052 | .071 | .060 |
| f = Friction Factor at $N_{Re}$ = 35,000 | 0468 | .0476 | .0741 | .0479 |

In Table I, the tube designated as I is a tube of the type described in Withers et al U.S. Pat. No. 3,847,212. Because tube I had a 1.0" nominal O.D., whereas later development work was done with tubes having a 0.75" O.D., a tube II was also tested which is equivalent in performance to tube I, but has an O.D. of 0.75". For example, each of tubes I and II have a $C_i$=0.052. Tube III was designed to provide a significant increase in outside surface area, $A_o$, by increasing the fin height. However, since fin height was increased while maintaining a constant outside diameter, the inside diameter was substantially reduced from that of tube II. A high severity of ridging causes the inside heat transfer coefficient constant $C_i$ of tube III to be much higher than the $C_i$ for tube IV of the present invention. However, the higher $C_i$ is obtained at the cost of a considerable increase in the friction factor f. Furthermore, it can be seen from Table I that tube IV has an internally ridged surface which differs considerably from tubes I–III in one or more aspects. For example, for the particular tube described, the ridge pitch, p=0.093", the ridge height, e=0.022", the ratio of ridge base width to pitch, b/p=0.731, and the helix lead angle of the ridge, $\theta$, as measured from the axis=33.5°. Preferably, p should be less than 0.124", e should be at least 0.015", b/p should be greater than 0.45 and less than 0.90 and $\theta$ should be between about 29° and 42° from the tube axis. It is even more preferable to have p less than about 0.100" and the angle $\theta$ between about 33° and 39°. We have found it still further preferable to have p less than about 0.094". A summary of design results for tubes II, III and IV is set forth in Table II.

TABLE II

Summary of Design Results for 300 Ton Submerged Tube Bundle Evaporator for Refrigerant R-11 Using Various Tubes in the ¾" O.D. Size to Form a Circular Bundle Having Triangular Layout with ⅛" Gap Spacing Between Tubes
Water Conditions: Temperature In = 54° F.; Out = 44° F.
Pressure Drop = 9.0 psi; Fouling Factor,FF = 0.00024 based on true inside area

| TUBE DESIGNATION | II | III | IV |
|---|---|---|---|
| Refrigerant Temperature,°F. | 40 | 40 | 40 |
| Number of Water Side Passes | 3 | 2 | 2 |
| Intube Water Velocity, fps | 5.4 | 5.7 | 7.6 |
| Overall Heat Transfer Coeff, $U_o$ | 418 | 637 | 1148 |
| Tubing Required | | | |
| Number of Tubes | 414 | 312 | 194 |
| Tube Length, feet | 13.4 | 11.6 | 10.6 |
| Total Footage, feet | 5535 | 3613 | 2057 |
| Feet per Ton | 18.5 | 12.0 | 6.9 |
| Bundle Diameter, inches | 19.0 | 15.3 | 12.1 |

Table II compares the projected overall performance of tubes II, III and IV when arranged in a bundle in a particular refrigeration apparatus which provides 300 tons of cooling. A rigorous computerized design procedure based on experimental data was used. The procedure takes into account the performance characteristics derived from various types of testing. As can be seen from the table, tube IV provides far superior overall performance as compared to tube II or tube III. For example, by using tube IV, the amount of tubing required to produce a ton of refrigeration is just 6.9', as compared to 18.5' for tube II and 12.0' for tube III. This represents savings of 63% and 43% in the amount of tubing required, as compared to tubes II and III, respectively. Besides reducing the length, and therefore the cost, of tubing required, the use of tube IV also reduces the size of the tube bundle from the 19.0" or 15.3" diameters required for tubes II and III to 12.1". This makes the apparatus far more compact and also results in substantial additional savings in the material and labor required to produce the larger vessels and supports needed to house a larger diameter tube bundle.

The graphs of FIGS. 9 and 10 are provided to further compare the particular tubes described in Tables I and II. FIG. 9 is a graph similar to FIG. 12 of the aforementioned Withers et al U.S. Pat. No. 3,847,212 and illustrates the relationship between heat transfer and pressure drop in terms of the inside heat transfer coefficient constant $C_i$, and the friction factor f, where $C_i$ is proportional to the inside heat transfer coefficient and is derived from the well known Sieder-Tate equation. It is well known that pressure drop is directly proportional to friction factor when one compares tubes of a given diameter at the same Reynolds number. In the U.S. Pat. No. 3,847,212, the tube which was the subject matter of that patent, and which is tube I in Table I, had multiple starts and internal ridges with intermediate flats. In FIG. 12 of the U.S. Pat. No. 3,847,212, that disclosed tube was shown, for a Reynolds number of 35,000, to have an improved heat transfer coefficient for a given pressure drop when compared to a prior art single start tube having a ridge with a curvalinear inner wall profile. In the graph of FIG. 9, tubes made according to the teachings of U.S. Pat. No. 3,847,212 are indicated as falling on the curved line 82. The aforementioned prior art single start ridged tube is shown by line 84. It can be readily seen that the tube III of Table I, characterized by having 10 ridge starts, a fin height of 0.061", a helix angle of 60.1, a pitch of 0.949", a b/p ratio of 0.706 and a ridge height of 0.024", has a much higher $C_i$ than the multiple and single start tubes indicated by lines 82 and 84. However, the higher $C_i$ of tube III comes at least partly at the cost of a greatly increased value for the friction factor f, and thus, increased pressure drop. The graph also shows the plot of a data point for the improved tube IV of the present invention and clearly illustrates that a very substantial improvement in $C_i$ can be made with substantially no increase in pressure drop as compared to the plotted data points for either tube II or tube III. As previously discussed, the tube II was made in accordance with the teachings of U.S. Pat. No. 3,847,212 but has an I.D. of 0.75", 10 ridge starts, a fin height of 0.033", a ridge helix angle of 48.4°, a pitch of 0.167" and a b/p ratio of 0.413. The U.S. Pat. No. 3,847,212 defined the ridge angle $\theta$, as being measured perpendicularly to the tube axis, but in the instant specification, the ridge helix angle is defined as being measured relative to the axis, since this seems to be more conventional nomenclature.

Based on test results, projections have been made for the tubing requirements in designing a 300 ton submerged tube bundle evaporator. The projections had to take into account, not only the water (inner) side performance characteristics but the boiling (outer) side performance characteristics as well. When this was done, tube III yielded a substantial degree of improvement over tube II, part of which (about 11%), was due to improved inside characteristics. However, similar projections showed a much greater increase in overall tube performance for tube IV as compared to tube II, even though its $C_i$ was substantially lower than that for tube III. For example, its overall performance was 74% better than for tube III and 168% better than for tube II.

Whereas FIG. 9 relates to the internal heat transfer properties of various tubes, FIG. 10 is related to the external heat transfer properties in that it graphs a plot of the external film heat transfer coefficient, $h_b$ to the Heat Flux, $Q/A_o$*. These terms come from the conventional heat transfer equation, $Q=h_b(A_o)\Delta t$ wherein Q is the heat flow in BTU/hour; $A_o$ is the outside surface area and Δt is the temperature difference in °F. between the outside bulk liquid temperature and the outside wall surface temperature. For simplicity purposes, the outside surface $A_o$* is the nominal value determined by multiplying the nominal outside diameter by Pi and by the tube length. It can readily be seen that tube III shows improved boiling performance over that of tube II, and likewise, tube IV indicates substantially greater performance than tube II. Tube I was omitted since it was a larger diameter tube. Tube II, as previously mentioned, is equivalent to tube I but has the same O.D. as tubes III and IV. The graph relates to a single tube boiling situation. However, we have found, as can be seen from the performance results for tube IV, as noted in Table II, that the performance in a bundle boiling situation is significantly enhanced.

Although only tubes for nucleate boiling have been discussed in detail, the invention also is of significant value in condensing applications. For such applications, the final step of rolling down or flattening the fin tips would be omitted.

We claim:

1. In a process of making a heat transfer tube with an improved outside surface for nucleate boiling comprising the steps of finning the tube to produce helical fins thereon, forming a plurality of transverse grooves around the periphery of each fin, and progressively compressing the tips of the grooved fins to cause them to become flattened and of a width in an axial direction which is slightly less than their pitch, thereby defining a narrow opening between fins which is in communication with a rather large cavity defined by the sides of adjacent fins in the region under the flattened fin tips, the improvement wherein said tips are variably compressed so that the width of the narrow openings between adjacent fins is varied so as to produce a range of opening widths which is both larger and smaller than the optimum minimum pore size for nucleate boiling of a particular fluid under a particular set of operating conditions.

2. A process according to claim 1 wherein said tube is formed in a single pass.

3. A process according to claim 2 and further including the step of forming a plurality of helical internal ridges on the inner surface of the tube.

4. A process according to claim 3 wherein said plurality of helical internal ridges are formed so as to have a pitch of less than 0.124 inches, a ratio of ridge base width to pitch, as measured along the tube axis, which is greater than 0.45 and less than 0.90 inches, a helix lead angle which is between about 29 and 42 degrees, and wherein the fins are formed so as to be spaced at a pitch which is less than 50% of the pitch of the helical internal ridges.

* * * * *